US006990760B1

(12) United States Patent
Zaayman et al.

(10) Patent No.: US 6,990,760 B1
(45) Date of Patent: Jan. 31, 2006

(54) LIP FOR AN EXCAVATION BUCKET

(75) Inventors: Oswald Cornelius Dannhauser Zaayman, Pretoria (ZA); Schalk Willem Petrus Esterhuyse, Pretoria (ZA)

(73) Assignee: Caterpillar Sarl, Geneva (CH)

( * ) Notice: Subject to any disclaimer, the term of this patent is extended or adjusted under 35 U.S.C. 154(b) by 0 days.

(21) Appl. No.: 09/688,513

(22) Filed: Sep. 14, 2000

(51) Int. Cl.
*E02F 3/36* (2006.01)

(52) U.S. Cl. ..... 37/446

(58) Field of Classification Search ..... 37/452, 37/455, 450, 446, 398, 341, 342, 379, 444, 37/903
See application file for complete search history.

(56) References Cited

U.S. PATENT DOCUMENTS 2,778,129 A * 1/1957 Fryer ..... 37/449
2,981,015 A * 4/1961 Duke ..... 37/449
3,011,274 A * 12/1961 Richter ..... 37/449
3,059,357 A * 10/1962 Irish ..... 37/449
3,281,972 A * 11/1966 Kerestes
3,500,562 A * 3/1970 Reinhard ..... 37/449
3,775,879 A * 12/1973 Quick
3,984,929 A * 10/1976 Meyer et al. ..... 37/449
4,043,060 A * 8/1977 Stepe ..... 37/446
4,123,861 A * 11/1978 Hemphill
4,359,102 A * 11/1982 Gurries et al.
4,570,365 A * 2/1986 Bierwith
4,671,000 A * 6/1987 Kim ..... 37/451
5,575,092 A * 11/1996 Smit
6,230,424 B1 * 5/2001 Renski et al. ..... 37/446
6,237,260 B1 * 5/2001 Gooch
6,363,633 B1 * 4/2002 Holzer et al. ..... 37/446
6,434,865 B2 * 8/2002 Renski et al. ..... 37/446

* cited by examiner

*Primary Examiner*—Victor Batson
(74) *Attorney, Agent, or Firm*—Kilpatrick Stockton

(57) ABSTRACT

The invention relates to a lip for an excavation bucket. The lip includes a lower plate defining a plurality of integral projections along a front edge thereof, an upper plate and a central plate sandwiched between the lower plate and the upper plate so as to form a laminated structure. The upper plate also defines a plurality of integral projections which together with the projections on the lower plate form tool attachment formations in a serrated front edge of the laminated structure for supporting ground-engaging tools on the lip.

8 Claims, 1 Drawing Sheet

LIP FOR AN EXCAVATION BUCKET

BACKGROUND OF THE INVENTION

THIS invention relates to excavation buckets, and more specifically to a lip for an excavation bucket.

Excavation buckets such as dragline buckets generally have a lip welded to the front of the bucket for supporting a plurality of ground-engaging tools. These lips are usually formed from a single, rolled steel or cast steel plate with a straight front edge, and include a plurality of nosepiece castings which are fixed to the lip so as to project from the front edge of the lip. Ground-engaging tools are mechanically attached to the nosepieces, typically by means of adaptor castings.

The castings tend to be relatively heavy and consequently contribute significantly to the overall mass of the lip. Since the total mass of a loaded dragline bucket is limited by the dragline rated suspended load (RSL), it is desirable to reduce the mass of the bucket so as to allow for an increase in the bucket load and hence the productivity of the dragline.

A further disadvantage associated with conventional lips for dragline buckets is that the nosepiece castings have to be welded to the lip with transverse welds that extend across the upper and lower surfaces of the lip, and these welds reduce the fatigue strength of the lip.

SUMMARY OF THE INVENTION

According to the invention there is provided a lip for an excavation bucket including a lower plate defining a plurality of integral projections along a front edge thereof, and an upper plate joined to the lower plate so as to form a laminated structure, the upper plate defining a plurality of integral projections which together with the projections on the lower plate form tool attachment formations in a serrated front edge of the laminated structure for supporting ground-engaging tools on the lip.

Preferably, at least one additional plate is sandwiched between the upper plate and the lower plate. In this case, the additional plate or plates may be designed to project from the upper and lower plates between adjacent tool attachment formations and may include apertures for attaching shrouds to the lip between the tool attachment formations.

Typically, the lip includes one additional plate between the upper and lower plates, and the additional plate defines openings along its length for reducing the mass of this plate.

In a particularly preferred embodiment, the projections on the upper and lower plates are bent out of the planes of these plates so that the tool attachment formations are inclined relative to the plane of the lip.

Preferably, the upper plate, the lower plate and the additional plate are fabricated from rolled steel plate and are subsequently welded together.

In one arrangement, the lip curves upwardly at each lateral end thereof so that welds at these lateral ends are located out of areas of high stress in use.

The invention also extends to an excavation bucket including a lip as described above.

BRIEF DESCRIPTION OF THE DRAWINGS

The invention will now be described in more detail, by way of example only, with reference to the accompanying drawings in which.

DESCRIPTION OF AN EMBODIMENT

Figures 1, 2, 3:
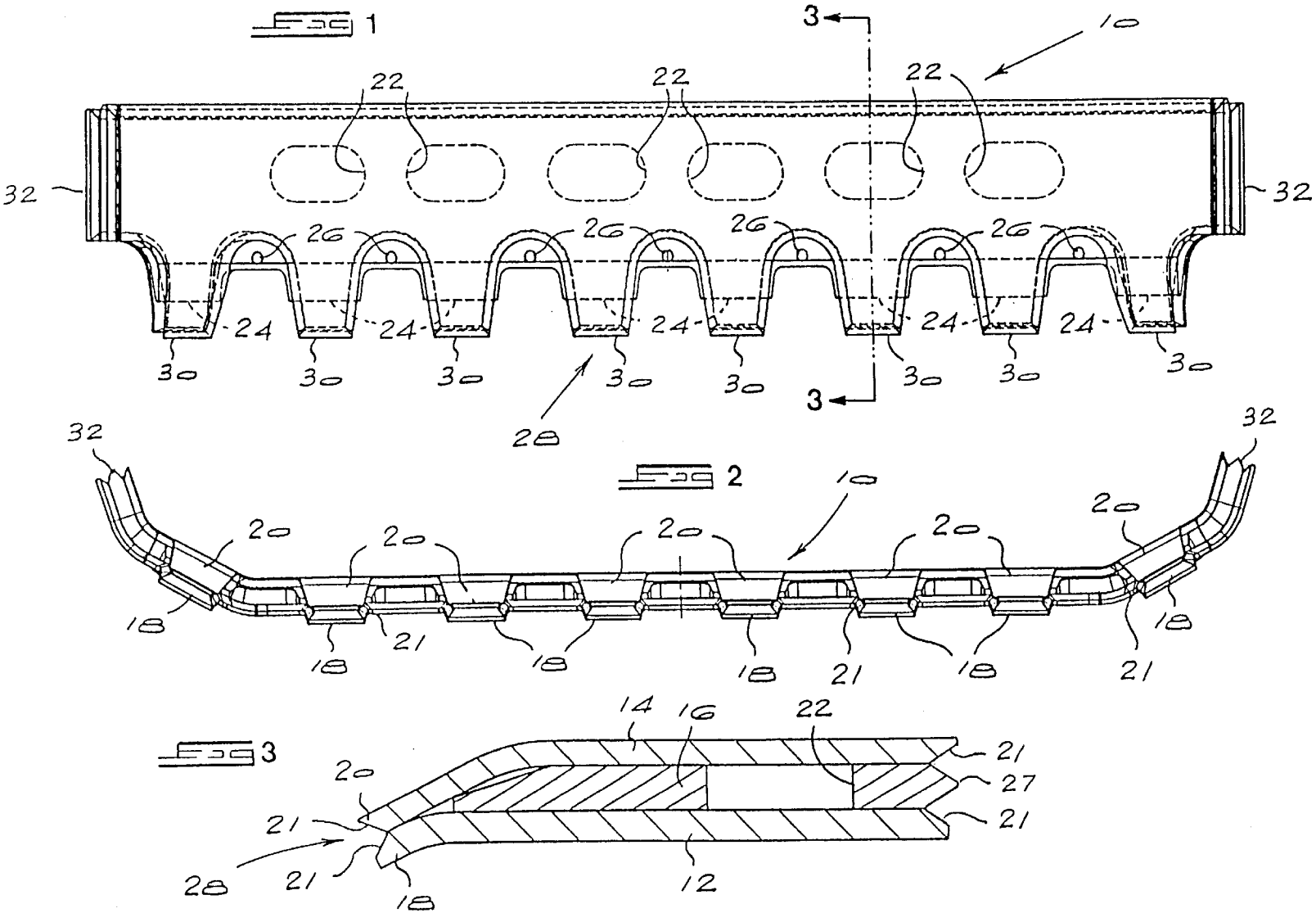
FIG. 1 shows a top view of a lip according to the present invention.
FIG. 2 shows a front view of the lip illustrated in FIG. 1.
FIG. 3 shows a cross-sectional view along the line 3—3 in FIG. 1.

FIG. 1 of the drawings illustrates a top view of a lip for an excavation bucket according to the present invention. The lip is designated generally with the reference numeral 10 and is formed from three steel plates which are welded together in a manner which is described in more detail below.

With reference also to FIG. 3 of the accompanying drawings, the steel plates forming the lip 10 include a lower plate 12, an upper plate 14 and a central plate 16 which is sandwiched between the lower and upper plates, as shown. The lower plate and the central plate are formed from a high strength steel having a minimum yield strength of 700 $N/mm^2$, typically WELDOX™ 700D, and the upper plate is formed from an abrasion resistant steel with a minimum hardness of 40 Rockwell C, typically HARDOX™ 400.

The lower plate 12 defines eight integral projections 18 (see FIG. 2) which are formed by cutting recesses into a front edge of this plate. The projections are inclined downwardly out of the plane of the plate 12, as shown most clearly in FIG. 3. The upper plate 14 also defines eight integral projections 20 which correspond with the projections 18 on the lower plate and which are inclined downwardly out of the plane of the upper plate, as illustrated. To facilitate the welding of the plates, the peripheral edges of the upper and lower plates are seen to include bevel surfaces 21.

The central plate 16 includes six openings 22 for reducing the mass of this plate and is machined so as to accommodate the inclined projections 20 on the upper plate. Along a front edge of the central plate 16 eight projections 24 are provided which are arranged to correspond with the projections 18 and 20, and the plate 16 defines seven apertures 26 between adjacent projections 24 which are arranged to receive connection pins for securing seven shrouds to the lip 10. The rear edge 27 of the central plate 16 tapers inwardly, as shown in FIG. 3, to facilitate welding of this plate to the upper and lower plates.

In this embodiment of the invention, the lip 10 is assembled in the following manner. First, the three plates 12, 14 and 16 are formed separately by fabricating three rolled steel plates. During fabrication, the plates are profiled in a flame-cutting machine, the central plate is machined as required, and the projections 18 and 20 on the upper and lower plates are bent relative to these plates. The three plates are then placed one above the other, as illustrated in FIG. 3, with the central plate sandwiched between the upper and lower plates, and are pressed together in a press to ensure proper engagement. Thereafter, the plates are welded together with welds (not illustrated) that extend along the bevel surfaces 21 around the periphery of the plates, or at least a substantial portion of the periphery of the plates, to form a laminated structure.

The lip formed from the three plates 12, 14 and 16 includes a serrated front edge 28 which defines eight tool attachment formations 30 (see FIG. 1) for supporting ground-engaging tools (not shown). Typically, the ground-engaging tools are welded to the tool attachment formations as wear elements that can be replaced when worn.

Seven shrouds (not shown) are then connected to the lip between the tool attachment formations 30 with connection pins (also not shown) which are arranged to engage in the apertures 26.

In this embodiment of the invention, the lip is welded to a dragline bucket but it should be appreciated that the lip could also be connected to various other types of excavation buckets. In FIG. 2, the lip 10 is seen to curve upwardly at each side edge thereof so that lateral edges 32 of the lip can be welded directly to cheek plates on the dragline bucket out of areas of high stress in use.

One advantage of the lip according to the embodiment of the invention described above is that it is relatively light when compared with conventional lips for dragline buckets. This is mainly due to the fact that ground-engaging tools are welded directly to the tool attachment formations and consequently there is no need for nosepiece castings or adaptor castings which tend to be fairly heavy. Also, the openings 22 in the central plate 16 serve to reduce the overall mass of the lip. This lip mass reduction is important because it allows for a larger bucket load and consequently an increase in the productivity of the dragline.

A further advantage of the lip of the invention is that there are no welds on the upper or lower surface of the lip since all of the welds on the plate 14 extend around the periphery of this plate. In conventional lips for dragline buckets it is necessary to have transverse welds on the upper and lower surfaces of the lip in order to connect the nosepiece castings to the lip. The absence of these transverse welds on the lip of the invention allows for a lip with increased fatigue strength.

We claim:

1. A lip for an excavation bucket including a lower plate defining a plurality of integral projections along a front edge thereof;

an upper plate joined to the lower plate so as to form a laminated structure, the upper plate defining a plurality of integral projections which, together with the projections on the lower plate, form tool attachment formations in a serrated front edge of the laminated structure for supporting ground-engaging tools on the lip;

at least one additional plate between the upper plate and the lower plate; and the at least one additional plate projecting from the upper and lower plates, between adjacent tool attachments formations, for attaching shrouds to the lip.

2. A lip for an excavation bucket according to claim 1, wherein the projections on the upper and lower plates are arranged so that the tool attachment formations are inclined relative to the plane of the lip.

3. A lip for an excavation bucket according to claim 1, wherein the upper plate, the lower plate and the additional plate or plates are fabricated from rolled steel plate and are subsequently welded together.

4. A lip for an excavation bucket according to claim 1, wherein the lip curves upwardly at each lateral end thereof.

5. An excavation bucket including a lip according to claim 1.

6. A lip for an excavation bucket according to claim 1, wherein the additional plate defines openings along its length for reducing the mass of the additional plate.

7. A lip for an excavation bucket including a lower plate defining a plurality of integral projections along a front edge thereof, and an upper plate joined to the lower plate so as to form a laminated structure, the upper plate defining a plurality of integral projections which, together with the projections on the lower plate, form tool attachment formations in a serrated front edge of the laminated structure for supporting ground-engaging tools on the lip, at least one additional plate between the upper plate and the lower plate, and wherein the additional plate or plates are designed to project from the upper and lower plates between adjacent tool attachment formations and include attachment apertures for attaching shrouds to the lip.

8. A lip for an excavation bucket including a lower plate defining a plurality of integral projections along a front edge thereof, and an upper plate joined to the lower plate so as to form a laminated structure, the upper plate defining a plurality of integral projections which together with the projections on the lower plate form tool attachment formations in a serrated front edge of the laminated structure for supporting ground-engaging tools on the lip, at least one additional plate between the upper plate and the lower plate, and wherein the lip includes on additional plate between the upper and lower plates, and the additional plate defines openings along its length for reducing the mass of this plate.

* * * * *